United States Patent [19]

Witting

[11] 4,129,895

[45] Dec. 12, 1978

[54] CURRENT WAVE SHAPES FOR JET ENGINE FUEL IGNITERS

[75] Inventor: Harald L. Witting, Burnt Hills, N.Y.

[73] Assignee: General Electric Company, Schenectady, N.Y.

[21] Appl. No.: 770,508

[22] Filed: Feb. 22, 1977

[51] Int. Cl.[2] ..... H01T 15/02

[52] U.S. Cl. ..... 361/257; 315/209 CD

[58] Field of Search ..... 361/256, 257; 315/209 CD

[56] References Cited

U.S. PATENT DOCUMENTS

| | | | |
|---|---|---|---|
| 2,584,507 | 2/1952 | Smits | 315/209 CD |
| 2,811,676 | 10/1957 | Smits | 361/257 |
| 3,127,540 | 3/1964 | Collins | 315/209 CD |
| 3,383,553 | 5/1968 | Parish et al. | 361/257 |
| 3,629,652 | 12/1971 | Maycock et al. | 315/209 CD |

FOREIGN PATENT DOCUMENTS

| | | | |
|---|---|---|---|
| 2550125 | 5/1976 | Fed. Rep. of Germany | 361/256 |

*Primary Examiner*—J. V. Truhe
*Assistant Examiner*—Clifford C. Shaw
*Attorney, Agent, or Firm*—Lawrence D. Cutter; Joseph T. Cohen; Marvin Snyder

[57] ABSTRACT

Jet engine fuel igniters are excited with a current waveform which maintains an intermediate current value until a discharge has separated from the igniter surface. The current then rises to a higher level to provide sufficient energy for ignition of an air-fuel mixture. Ignition reliability is thus increased and the effects of erosion on the igniter surface are decreased.

11 Claims, 5 Drawing Figures

CURRENT WAVE SHAPES FOR JET ENGINE FUEL IGNITERS

This invention relates to exciter circuits for operating fuel igniters in gas turbine engines. More specifically, this invention relates to circuits and method for delaying a high current igniter pulse to reduce wear and erosion of igniter contacts and surfaces.

BACKGROUND OF THE INVENTION

Jet engine igniters are used, in a manner similar to automobile spark plugs, to ignite an air-fuel mixture in the combustion chambers of gas turbine engines. Igniters typically comprise two concentric electrodes separated by an insulator, for example, aluminum oxide. A high voltage is applied to the central electrode to initiate an electric discharge in the air-fuel mixture. Current in the electric discharge then rises to deliver sufficient energy to initiate ignition of the mixture.

Jet aircraft engine igniters are utilized during engine startup and are, additionally, operated as a precaution against flame-out during take off, landing, and poor weather conditions. Typically, an igniter is operated approximately ten percent of engine running time.

Igniters for engines in heavy jet aircraft typically operate under particularly severe conditions. For example, in the General Electric Company CF6-50 engine, which powers the McDonald-Douglas DC 10 aircraft, a power supply (the exciter) delivers brief, high voltage pulses to the igniter with a pulse energy in the range of from 1 to 2 joules at a repetition rate of 2 pulses per second. The igniter must operate over a pressure range from approximately 5 psia to over 200 psia at shell temperatures which range to approximately 2000° F. Frequently, igniters become covered with liquid jet fuel under cold starting conditions. The lifetime of an igniter is, therefore, limited to approximately 100 hours of exciter operation.

The insulator in prior art igniters has frequently been shunted with a body of semiconductor material, for example, a thin film on the insulator surface. Such "shunted igniters" have been found to fire at substantially lower voltages than unshunted igniters and thus tend to reduce the weight and cost of associated exciter circuits. The high power required for reliable ignition in heavy jet engines has, however, been found to cause a rapid erosion of the semiconducting film, a condition which leads to unreliable ignition.

SUMMARY OF THE INVENTION

I have conducted high speed, photographic studies of arc discharges on igniters of heavy jet aircraft engines and have determined that the discharge initiates along an insulator surface and, after delay of several microseconds, tends to move away from the insulator surface at near sonic velocities. With prior art exciter circuits, substantial energy is delivered in a short arc, close to the insulator surface subjecting the insulator ceramic to severe thermal stress.

I have, further, determined that thermal stress on igniter insulators may be reduced by use of an exciting current waveform which initiates a discharge under relatively low power conditions and, after the discharge has moved away from the insulator surface, increases the discharge power to assure reliable fuel ignition. Thermal stress is thus reduced and igniter lifetime increased by a circuit which provides substantially more reliable ignition than did prior art exciter circuits.

It is, therefore, an object of this invention to provide exciter circuits for increasing the lifetime of jet engine fuel igniters.

Another object of this invention is to increase the reliability of jet engine fuel igniter equipment.

Another object of this invention is to delay the main pulse in jet engine igniter circuits until a discharge column has separated from the igniter surface.

BRIEF DESCRIPTION OF THE DRAWINGS

The novel features which are believed to be characteristic of the present invention are set forth in the appended claims. The invention itself, together with further objects and advantages thereof, may best be understood by reference to the following detailed description, taken in connection with the appended drawings in which:

DESCRIPTION OF THE PREFERRED EMBODIMENT

Figure 1:
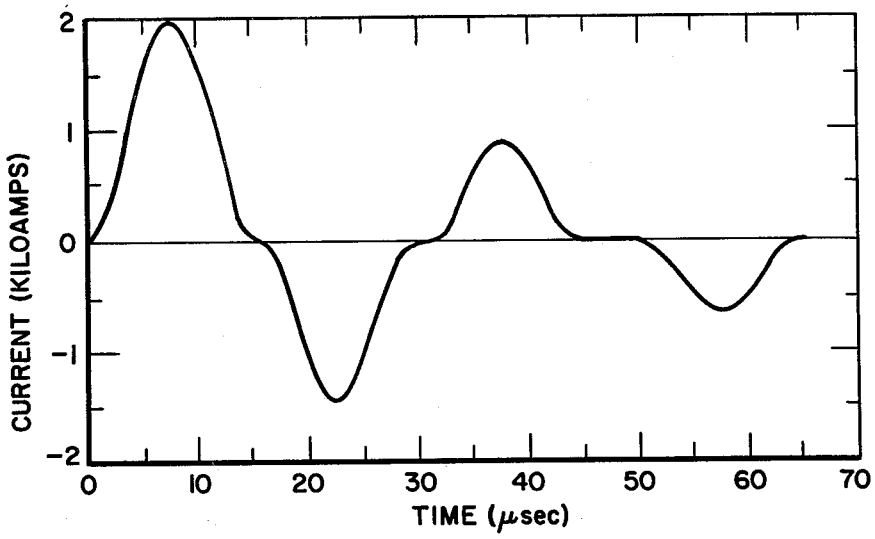
Fig. 1 (PRIOR ART)
FIG. 1 is the current waveform which is delivered to a jet engine igniter by an exciter circuit of the prior art.

FIG. 1 is a tracing of an oscillogram of the waveform delivered by a prior art exciter to an igniter in a General Electric CF6-50 jet engine. The exciter pulse, which provides high power required for fuel ignition, is approximately a damped sine wave with a main power pulse which reaches a level of approximately 2000 amperes within approximately 8 microseconds. High speed photographs of arc discharge columns produced by this exciter waveform in various models of shunted and unshunted igniters indicate that a discharge first forms as a narrow arc channel near the insulator surface. This channel does not move or change shape significantly during the first two microseconds, but then expands greatly and shoots up from the igniter surface at near sonic velocities (i.e., approximately 200 meters/second) as the current rises to 2000 amperes. On some igniters, the discharge concentrates again near the insulator surface on later half cycles of the discharge.

The movement of the discharge away from the surface is probably partially due to evaporation and expansion of material near the igniter surface. The movement may also be partly due to the well-known outward force exerted on a current in a curved path which is caused by the interaction of the current with its own magnetic field.

In accordance with the present invention, the performance of igniters may be improved by modifying the exciter circuit to delay the high current pulse of the main discharge until after approximately 30 microseconds of an intermediate current discharge (i.e., approximately 500–1000 amperes), have elapsed. In this manner, the high current pulse is delivered after the discharge has moved a few millimeters away from the igniter surface. Delayed application of the main discharge pulse provides more reliable ignition because the discharge path is longer and extends further into the fuel-air mixture. It also tends to increase igniter life since the peak power is delivered further away from the delicate igniter surface.

Figure 2A:
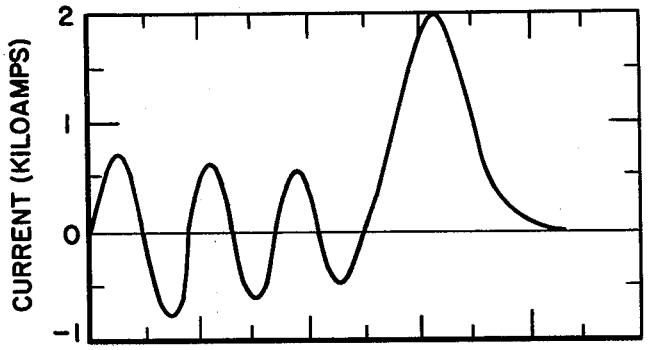
FIGS. 2*a*–2*c* are improved current waveforms for use with jet engine igniters in accordance with the present invention.
Figure 2B:
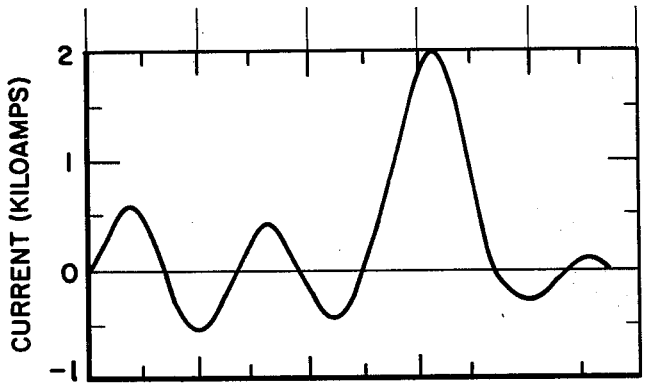
Figure 2C:
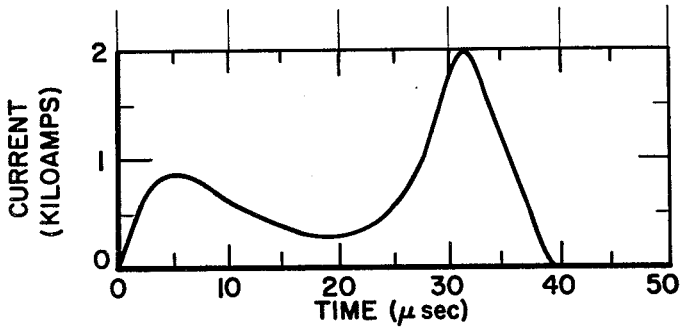

FIG. 2a–2c waveforms of improved current pulses of the present invention. In all cases, the application of the high current pulse is delayed for approximately 30 microseconds after the initiation of the discharge.

Figure 3:
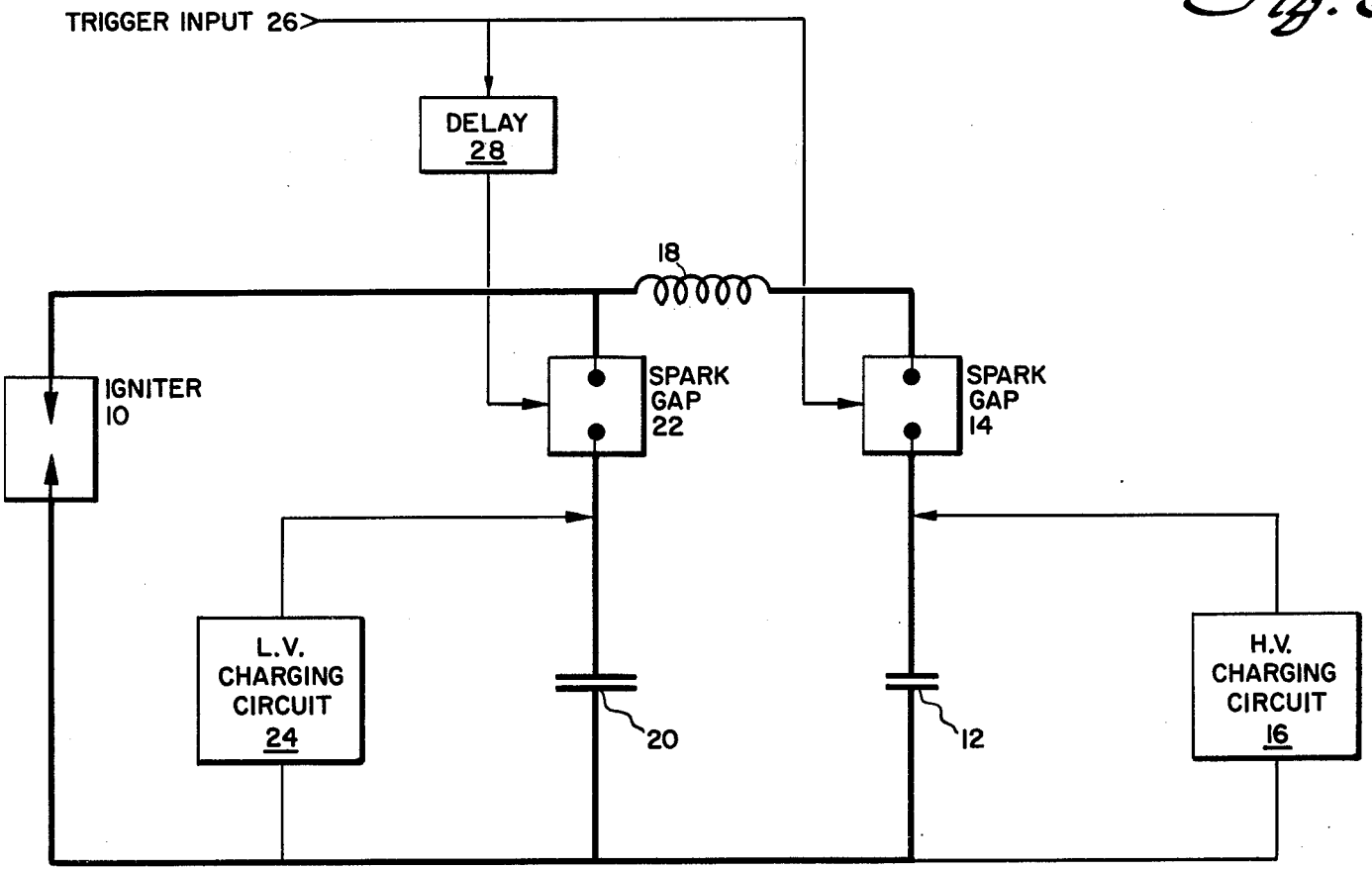
FIG. 3 is a circuit for generating the waveform of FIG. 2*c*.

FIG. 3 illustrates an exciter circuit for delivering a current waveform of the type illustrated in FIG. 2c. An igniter 10 is connected in series with a high voltage pulse capacitor 12, a triggered spark gap 14, and a current limiting inductor 18. A second pulse capacitor 20, which should have a larger energy storage capability than the first capacitor 12 and may have a lower voltage rating than that of the first capacitor, is connected in series with a second triggered spark gap 22 directly across the igniter 10. A high voltage charging circuit 16 which may be any of the various types of charging circuits utilized in capacitor discharge type circuits, is connected to the capacitor 12 while a second charging circuit 24, which may have a lower voltage rating than the charging circuit 16, is connected to the capacitor 20. A trigger input signal 26, which may be supplied by conventional exciter trigger circuitry, is initially delivered to the spark gap 14 which is connected in series with the high voltage capacitor 12. The trigger signal 26 is also applied to the spark gap 22 through a delay circuit 28 which, typically, provides approximately 30 microseconds delay.

The high voltage capacitor 12 provides a pulse which breaks down the igniter 10 gap and then provides a moderate current discharge through the igniter which is limited by series inductor 18. After a suitable delay, which allows the discharge to separate from the igniter surface, the second capacitor 20 delivers a larger main current pulse, at much lower voltage, to the igniter. The basic circuit illustrated in FIG. 3 may, if desired, be modified with voltage doubling circuits, output transformers, and other accessories which are well known and utilized in exciter circuits of the prior art.

The ratios of the magnitude of the current pulse delivered in the first portion of the waveform and that delivered during the main current pulse will, of course, be determined by the requirements of the particular igniter and engine configuration utilized. The low current pulse at the beginning of the waveform should typically have an amplitude from approximately ten percent to approximately 50 percent of the main current pulse. For the CF6-50 engine and igniters, a delay of 20–40 microseconds is indicated. If the delay is too short, the discharge will not separate sufficiently from the insulator surface while, if the delay is too long, the discharge may revert to a shorter path.

The circuits and methods of operation of the present invention provide increased ignition reliability in gas turbines and jet aircraft engines and extend the life-time of igniters which operate under high energy pulse conditions.

While the invention has been described in detail herein, in accord with certain preferred embodiments thereof, many modifications and changes therein may be effected by those skilled in the art. Accordingly, it is intended by the appended claims to cover all such modifications and changes as may fall within the true spirit and scope of the invention.

The invention claimed is:

1. An exciter for energizing a fuel igniter comprising:

means for initiating an electric discharge pulse across contacts of the igniter at an initial current level of sufficient magnitude to cause the discharge to separate and move away from a surface of the igniter; and means for increasing the power in the discharge, which means function to increase the current level in the discharge following a time delay of between approximately 20 microseconds and approximately 40 microseconds after initiation of the discharge, said level being sufficient to insure ignition of an air-fuel mixture.

2. The exciter of claim 1 wherein the means for increasing the power function to increase the current in the discharge to a level between approximately two times the initial current level and approximately ten times the initial current level.

3. The exciter of claim 2 wherein the means for increasing the power function to increase the current in the discharge to a level of aproximately 2000 amperes.

4. The exciter of claim 1 wherein the initial current is an alternating current.

5. The exciter of claim 1 wherein the initial current is a direct current.

6. The exciter of claim 1 wherein the means for initiating an electric discharge and the means for increasing the power comprise capacitors connected in series with triggerable spark gaps.

7. The exciter of claim 1 comprising, in combination:

a first capacitor;

a first triggerable spark gap connected in series with the first capacitor;

a current limiting inductor connected in series with the first capacitor and the first spark gap;

the combination of the first capacitor, the first triggerable spark gap, and the current limiting inductor being connected in series with the contacts of the igniter;

a second capacitor;

a second triggerable spark gap connected in series with the second capacitor;

the combination of the second capacitor and the second triggerable spark gap being connected in parallel with the contacts of the igniter;

means for charging the first capacitor and the second capacitor; and means for triggering the first triggerable spark gap whereby a discharge is initiated across the contacts of the igniter and for triggering the second spark gap at a time from between approximately 20 microseconds and approximately 40 microseconds following the initiation of the discharge, whereby current flow between the contacts of the igniter is caused to increase.

8. The exciter of claim 7 wherein the means for charging function to charge the first capacitor to higher voltage than the second capacitor.

9. A method for operating a fuel igniter comprising the steps of sequentially:

applying a high voltage pulse to the igniter to initiate a discharge between contacts thereof;

maintaining a current flow between the contacts of the igniter at a level sufficient to cause the discharge to separate from and move away from a surface of the igniter; and increasing the level of current flow across the contacts of the igniter, at a time from between approximately 20 microseconds and approximately 40 microseconds after the initiation of the discharge, to a current level sufficient to insure ignition of an air-fuel mixture.

10. The method of claim 9 wherein the current level sufficient to ignite said air-fuel is approximately 2000 amperes.

11. The method of claim 10 wherein the initial current level is between approximately 10 percent and approximately 50 percent of said current level sufficient to insure ignition of the air-fuel mixture.

* * * * *